US007004077B2

(12) United States Patent
Meindl

(10) Patent No.: US 7,004,077 B2
(45) Date of Patent: Feb. 28, 2006

(54) CABLE CAR SYSTEM

(75) Inventor: Bernd Meindl, Hard (AT)

(73) Assignee: Innova Patent GmbH, Wolfurt (AT)

( * ) Notice: Subject to any disclaimer, the term of this patent is extended or adjusted under 35 U.S.C. 154(b) by 25 days.

(21) Appl. No.: 10/756,909

(22) Filed: Jan. 14, 2004

(65) Prior Publication Data

US 2005/0081738 A1 Apr. 21, 2005

(30) Foreign Application Priority Data

Jul. 17, 2003 (AT) ..... A 1118/2003

(51) Int. Cl.
*B16B 12/00* (2006.01)

(52) U.S. Cl. ..... 104/173.1

(58) Field of Classification Search ..... 104/112, 104/173.1, 178, 180, 123, 125; 105/149.1
See application file for complete search history.

(56) References Cited

U.S. PATENT DOCUMENTS 1,149,764 A * 8/1915 Hinsen ..... 104/115
4,473,011 A * 9/1984 Wuschek ..... 104/173.1
4,802,416 A * 2/1989 Meinl ..... 104/192

* cited by examiner

*Primary Examiner*—Mark T. Le
(74) *Attorney, Agent, or Firm*—Laurence A. Greenberg; Werner H. Stemer; Ralph E. Locher

(57) ABSTRACT

A cable car system has two pairs of supporting cables that are respectively anchored in a valley station and in a mountain station. Cabins or similar people movers travel along the supporting cables while they are coupled to a self-contained traction cable. The cabins can be decoupled from the traction cable, to be moved in the stations along guide rails. The self-contained traction cable is formed with two loops, forming two strands in each case which are moved in the same direction and to which the cabins can be coupled.

13 Claims, 9 Drawing Sheets

CABLE CAR SYSTEM

BACKGROUND OF THE INVENTION

Field of the Invention

The present invention relates to a cable car system having two pairs of supporting cables that are anchored in a valley station and in a mountain station and along which cabins that are coupled to a self-contained traction cable can be moved. It is thereby possible to decouple the cabins from the traction cable, to be moved in the stations along guide rails.

Prior art cable car systems of this type have two pairs of supporting cables which are anchored in the valley station and in the mountain station and along which cabins can be moved. The cabins are provided with traveling mechanisms which are assigned to the two supporting cables of the pairs. Along the route, the movement of the cabins takes place by means of a self-contained conveying cable which is guided in the stations over a driving pulley, over reversing pulleys and over deflecting pulleys and to which the cabins are coupled when they leave one of the stations and from which the cabins are decoupled when they enter a station. The movement of the cabins in the stations takes place by means of deceleration wheels, conveying wheels and acceleration wheels which are arranged in the stations.

In the case of systems of this type, the tensile load of that strand of the traction cable to which the cabins traveling uphill are coupled increases from the valley station to the mountain station, the tensile load in the region of the mountain station being multiplied in comparison with the tensile load in the region of the valley station. The tensile load of that strand of the traction cable to which the cabins traveling downhill are coupled drops sharply in an analogous manner from the mountain station to the valley station.

According to the international CEN standards (CEN, European Committee for Standardization), the safety of the traction cable has to be at least 4.5, but it may not exceed 20. The reason for this maximum value is that the durability of the splice is not ensured by an excessive relaxing of the traction cable. This state of affairs means that limits are placed on the difference in the vertical positions of the cable car stations of a cable car system and on the number of cabins in the system. Those limits cannot be exceeded with conventional cable car technology.

SUMMARY OF THE INVENTION

It is accordingly an object of the invention to provide a cable car system, which overcomes the above-mentioned disadvantages of the heretofore-known devices and methods of this general type and which makes it possible to increase the height difference between the valley station and the mountain station without the conveying capacity of the system being reduced as a result.

With the foregoing and other objects in view there is provided, in accordance with the invention, a cable car system, comprising:

two pairs of supporting cables respectively anchored in a valley station and in a mountain station;

a self-contained traction cable formed with two loops substantially extending between the valley station and the mountain station, the traction cable having two strands commonly moving in a direction towards the valley station and two strands commonly moving in a direction towards the mountain station;

a plurality of cabins with coupling devices for coupling the cabins to the traction cable for movement along the supporting cables, and for decoupling the cabins from the traction cable for movement along guide rails respectively disposed in the valley station and in the mountain station.

In other words, the objects of the invention are achieved by the fact that the self-contained traction cable is formed with two loops. That is, it has two strands in each case which are moved in the same direction and to which the cabins can be coupled.

The two supporting cables of the respective pairs of supporting cables are preferably situated at a distance from each other which is greater than the width of the cabins, it being possible for the cabins to be moved between the two supporting cables of one of the pairs in each case, and the two strands of the traction cable, which strands are moved in the same direction, are also situated at a distance from each other which is greater than the width of the cabins, the cabins being situated between the respective two strands of the traction cable. In particular, the strands of the traction cable are situated transversely with respect to the direction of movement of the cabins between the cabins and the two supporting cables of one pair of the supporting cables in each case. Furthermore, the two supporting cables of one of the pairs can be connected to each other by means of bars which are situated above the same and are arranged at a distance from one another, these bars connecting the two supporting cables of a pair being fastened to the supporting cables from the lower side thereof by means of clamps. Furthermore, supporting rollers for the traction cable are preferably mounted on the bars.

Furthermore, the coupling apparatuses which are arranged on the suspension bars for the cabins can preferably be pivoted about an axis lying in the direction of movement of the traction cable in order to couple them to the strands of the traction cable, and the coupling apparatuses which are arranged on the suspension bars for the cabins can be pivoted about axes lying transversely with respect to the direction of movement of the traction cable and approximately horizontally in order to couple the same to the two strands of the traction cable. According to one preferred embodiment, the two strands of the traction cable, which strands are moved in the same direction, are guided along the route next to each other at approximately the same height, and, in one of the two stations, firstly, two deflecting pulleys, over which the respectively outer strand of the traction cable is guided, are provided and, secondly, a driving pulley having two cable grooves for all of the strands of the traction cable is provided, and in the other station the respectively inner strands of the traction cable are guided over a reversing pulley and the outer strands of the traction cable are guided over two mutually assigned deflecting pulleys.

Furthermore, the coupling apparatuses which are arranged on the supporting bars for the cabins are preferably designed with upwardly protruding supporting rollers which are assigned supporting surfaces which are situated on supports for hold-down rollers and along which the supporting rollers can be moved, as a result of which the coupling clamps can be lifted off the hold-down rollers in the vicinity thereof.

Other features which are considered as characteristic for the invention are set forth in the appended claims.

Although the invention is illustrated and described herein as embodied in a cable car system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
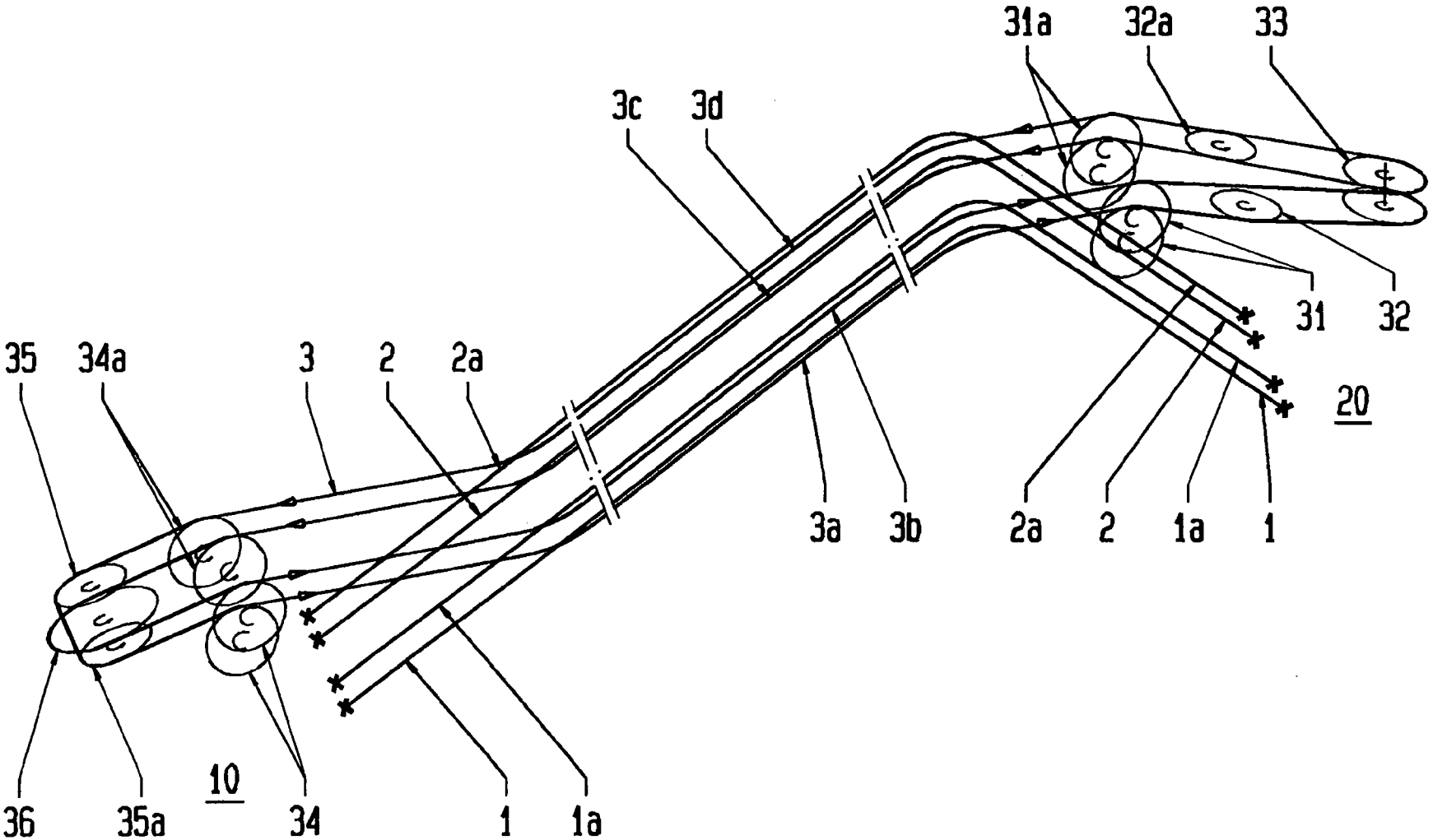
FIG. 1 is a schematic axonometric view of a cable car system according to the invention.

Referring now to the figures of the drawing in detail and first, particularly, to FIG. 1 thereof, there is shown a cable car system according to the invention with two pairs of supporting cables 1, 1*a* and 2, 2*a*. The pairs are disposed at the same height (i.e., level) and are anchored in the valley station 10 and in the mountain station 20. The two pairs of supporting cables 1, 1*a* and 2, 2*a* are assigned a single, self-contained traction cable 3 which has two upwardly moving strands 3*a*, 3*b* and two downwardly moving strands 3*c* and 3*d*. The upwardly moving strands 3*a*, 3*b* are assigned to the supporting cables 1, 1*a* and the downwardly moving strands 3*c*, 3*d* are assigned to the supporting cables 2, 2*a*.

In the mountain station 20, the strand 3*a* of the traction cable 3 is guided over a deflecting pulley 31 having a horizontal axis of rotation and over a deflecting pulley 32 having a vertical axis of rotation and over a driving pulley 33 having two cable grooves situated one above the other. The strand 3*a* merges there into the strand 3*c* which is guided over a deflecting pulley 31*a* having a horizontal axis. In the valley station 10, the strand 3*c* is guided over a deflecting pulley 34*a* having a horizontal axis and over a reversing pulley 36 having a vertical axis, the strand 3*c* merging there into the strand 3*b* which is guided over a deflecting pulley 34 having a horizontal axis. In the mountain station 20, the strand 3*b* is guided over a second deflecting pulley 31 to the second cable groove of the driving pulley 33 where it merges into the strand 3*d* which is guided over a deflecting pulley 32*a* having a vertical axis and a second deflecting pulley 31*a* having a horizontal axis. In the valley station 10, the strand 3*d* is guided over a second deflecting pulley 34*a* having a horizontal axis and over two deflecting pulleys 35 and 35*a* having vertical axes, the strand 3*d* then merging into the strand 3*a* which is guided over a second deflecting pulley 34.

This manner of guiding the traction cable 3 means that the latter is self-contained, the strands 3*a* and 3*b* being moved upward and the strands 3*c* and 3*d* being moved downward and all of the strands of the traction cable 3 having the same speed. The traction cable 3 is moved by the drive pulley 33.

Figure 2:
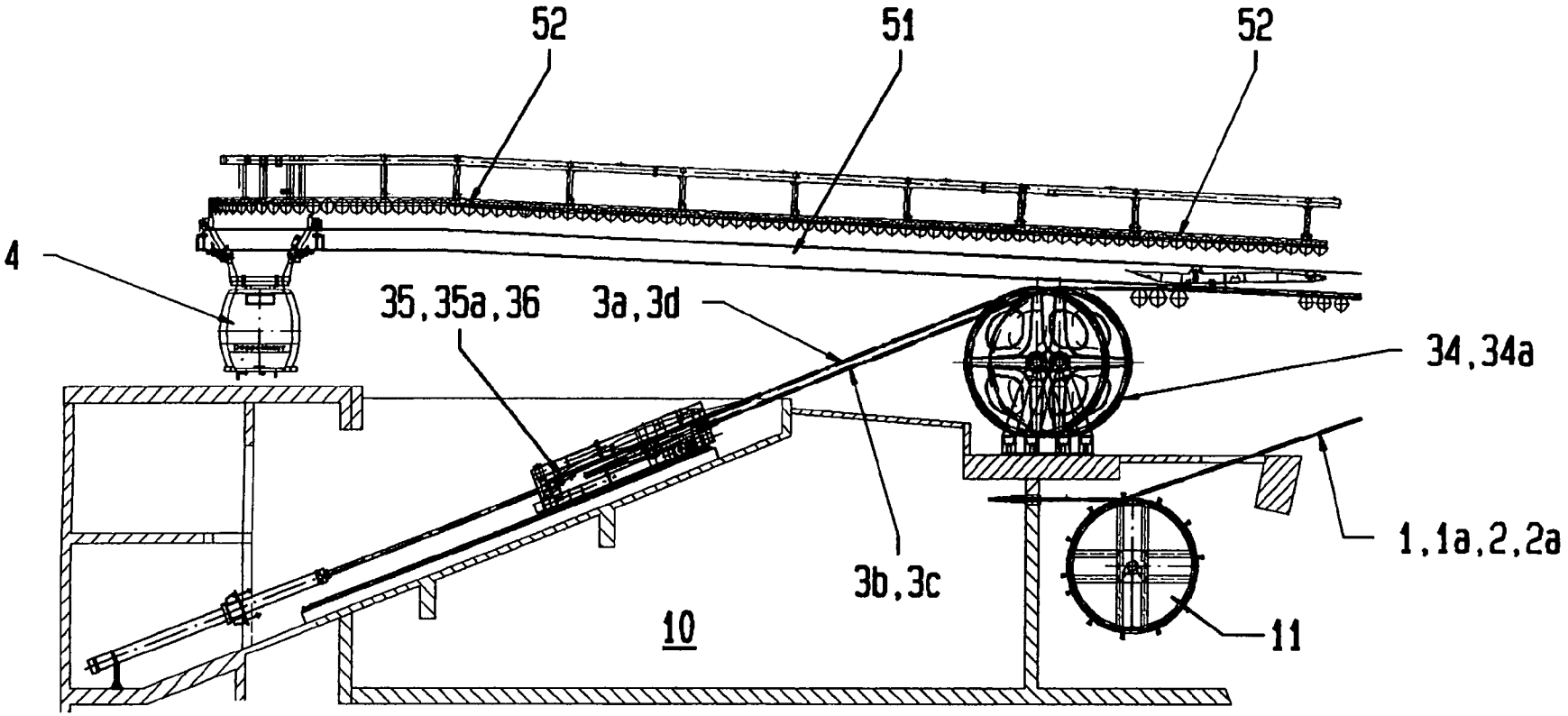
FIG. 2 is a vertical section taken through a valley station of the cable car system.
Figure 2A:
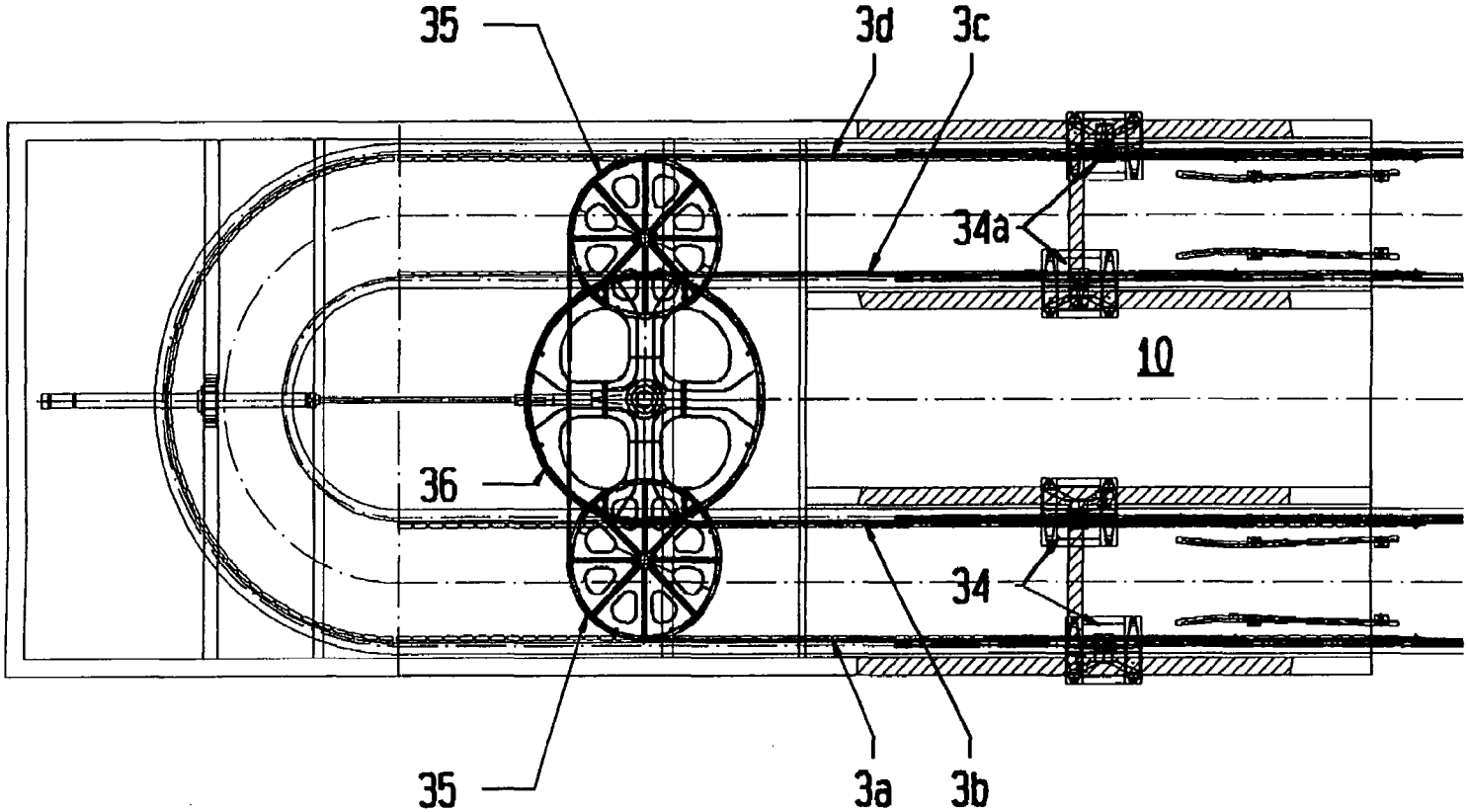
FIG. 2A is a plan view thereof.

Referring now to FIG. 2, the supporting cables 1, 1*a* and 2, 2*a* are securely anchored in the valley station 10 by means of a fixed drum 11 in each case. As is furthermore apparent from FIGS. 2 and 2A, the reversing pulleys 35, 35*a* and 36 can be moved in the direction of the cable 3, as a result of which the latter can be tensioned. The traction cable 3 is used to move cabins 4, which can be moved on the supporting cables 1, 1*a* and 2, 2*a*, along the route. In the valley station 10 and in the mountain station 20, the cabins 4 are decoupled from the traction cable 3 and are moved through the stations along guide rails. For this purpose, guide rails 51 and deceleration, conveying and acceleration wheels 52 are provided in the valley station 10.

Figure 3:
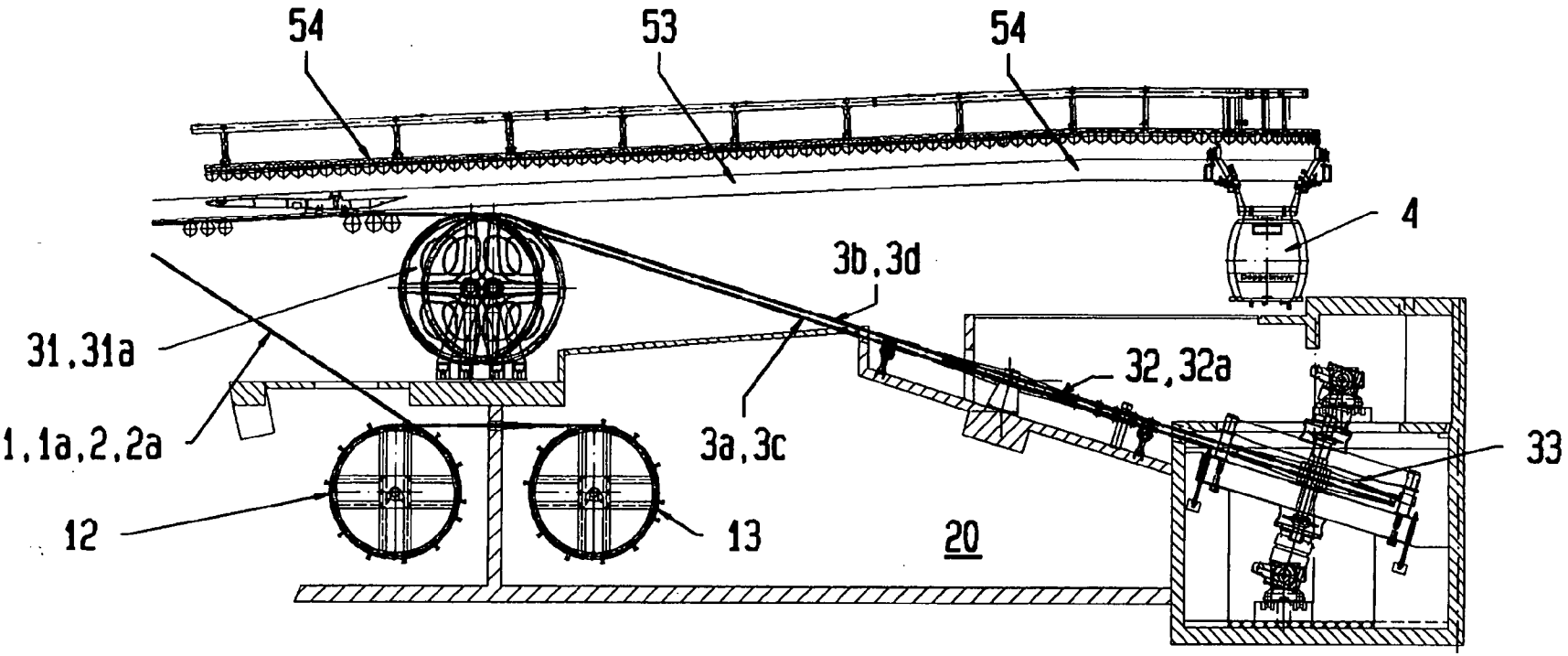
FIG. 3 is a vertical section taken through a mountain station of the cable car system.
Figure 3A:
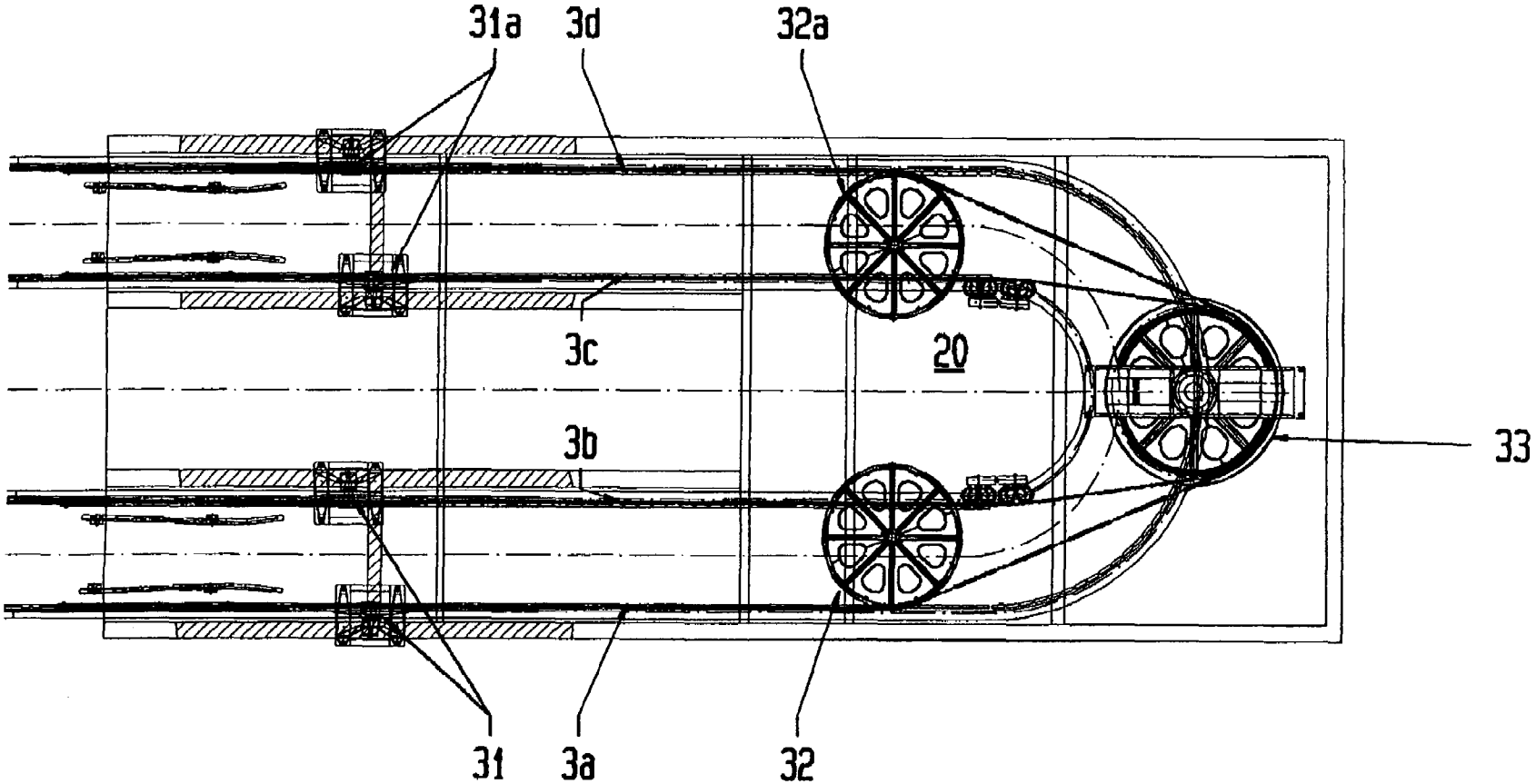
FIG. 3A is a plan view thereof.

As is apparent from FIG. 3, the supporting cables 1, 1*a* and 2, 2*a* are respectively anchored in the mountain station 20 via fixed drums 12 and 13. Guide rails 53 along which the cabins 4, which are decoupled from the traction cable 3, can be moved through the station 20 by means of deceleration, conveying and acceleration wheels 54 are provided in the mountain station 20.

Figures 4, 4A:
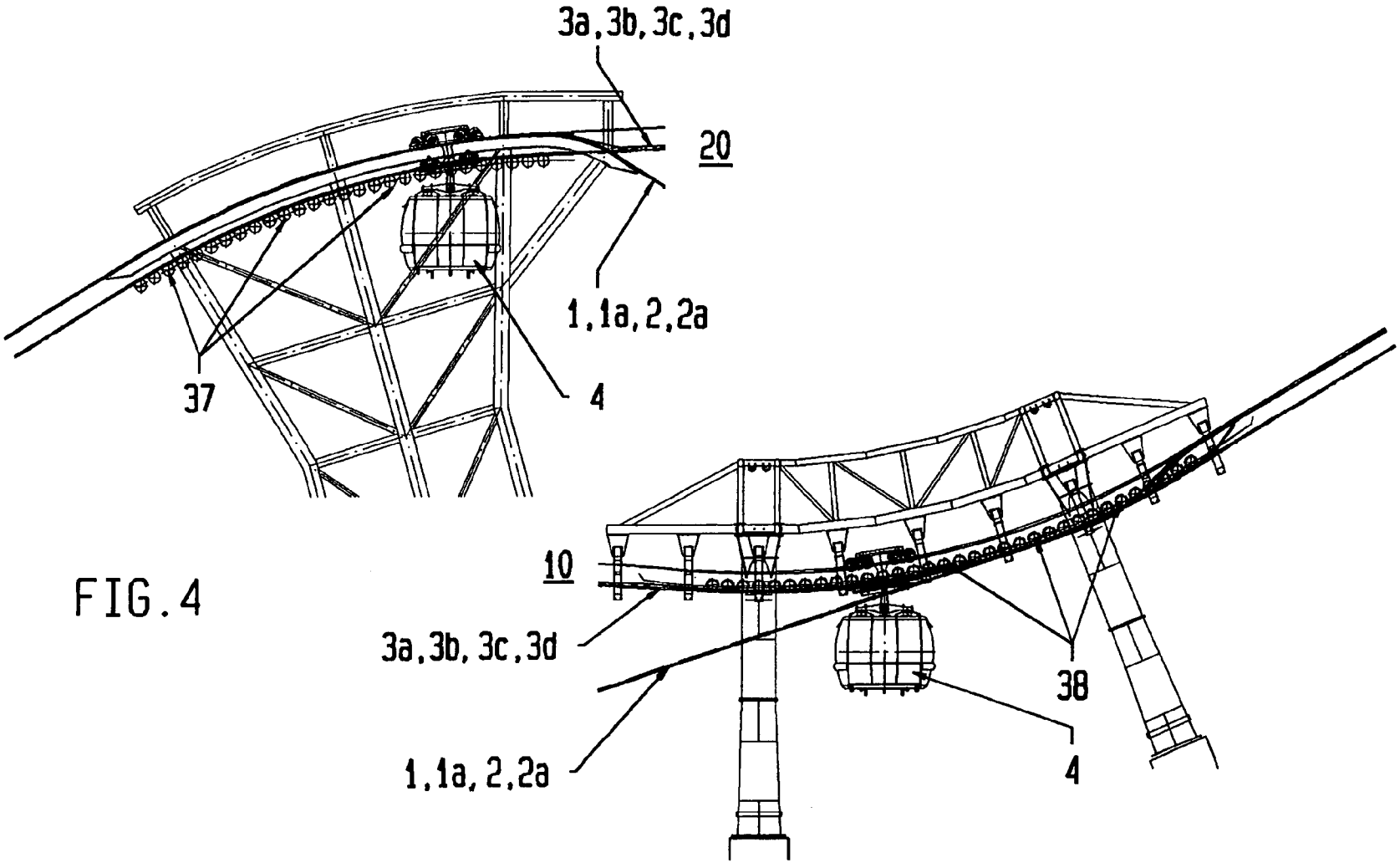
FIG. 4 is a side view showing the profile of the supporting cables and the traction cable in the vicinity of the mounting station.
FIG. 4A is a side view showing the profile of the supporting cables and the traction cable in the vicinity of the valley station.

As is apparent from FIGS. 4 and 4A, a group of supporting rollers 37 is provided in front of the mountain station 20. The rollers 37 are used to deflect the strands 3*a*, 3*b* of the traction cable into an approximately horizontal direction and to deflect the strands 3*c*, 3*d* from the horizontal direction. In an analogous manner, a group of hold-down rollers 38 is provided in front of the valley station 10, which rollers are used to deflect the strands 3*c*, 3*d* of the traction cable 3 in an approximately horizontal direction and to deflect the strands 3*a*, 3*b* from the horizontal direction. It is necessary to take structural measures in the case of the hold-down rollers 38 in order to avoid the cabins 4 being subjected to impact shocks by the clamping jaws of the coupling apparatuses traveling over the hold-down rollers 38.

Figure 5A:
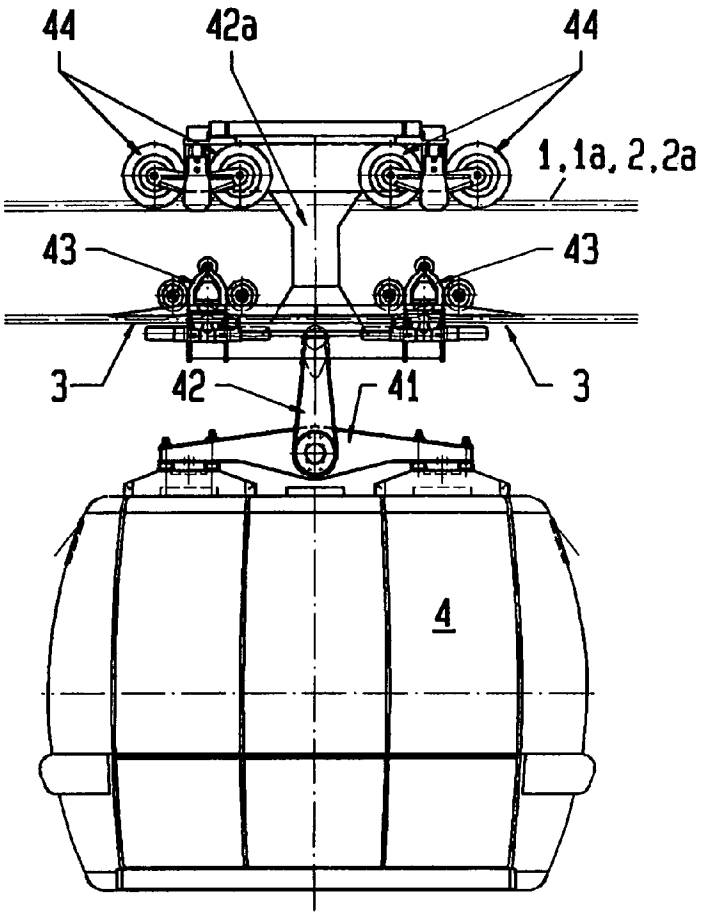
FIG. 5A is a side view thereof.
Figure 5:
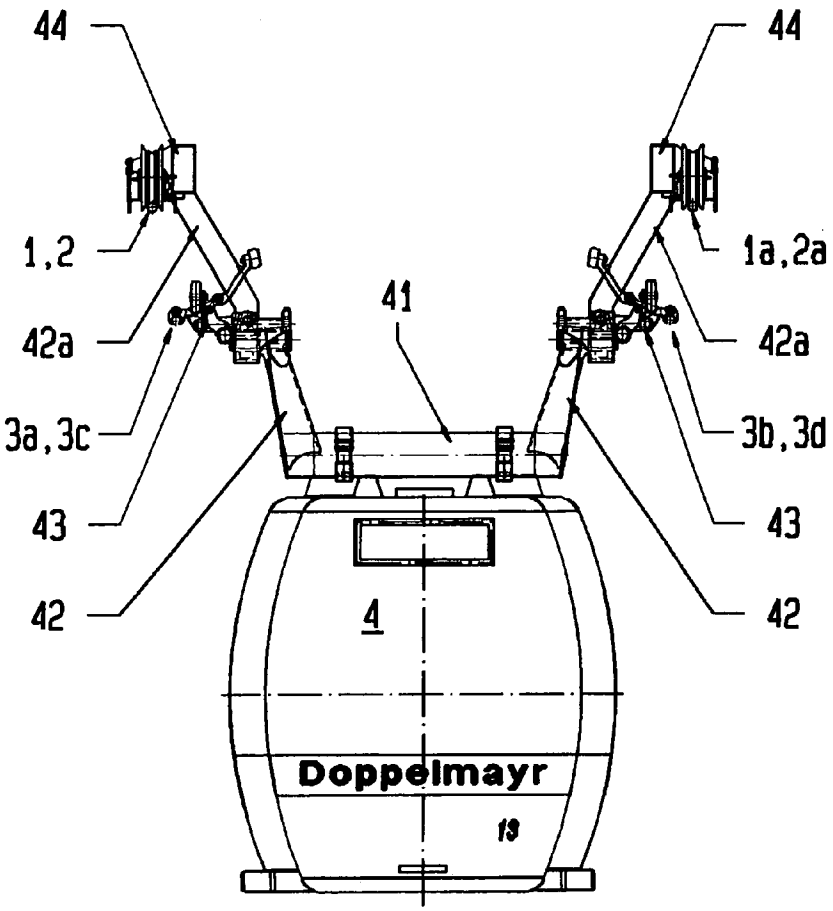
FIG. 5 is a front view of a cable car cabin that can be moved along two supporting cables by way of two strands of the traction cable.

With reference to FIGS. 5 and 5A, the cabins 4 are fastened to a supporting frame 41 having two supporting bars 42, 42*a* which are situated above the supporting frame, with damping devices being situated between the cabin 4 and the supporting frame 41. Coupling apparatuses 43 are situated on the supporting bars 42, 42*a* and running mechanisms 44 are situated above the coupling apparatuses. The coupling apparatuses 43 can be used to couple the cabins 4 onto the strands 3*a*, 3*b*, 3*c*, 3*d* of the traction cable 3 and the running mechanisms 44 can be used to move the cabins 4 along the supporting cables 1, 1*a* and 2, 2*a* and along the guide rails 51 and 53 in the stations 10, 20. The coupling apparatuses 43 are known from the prior art.

Figure 5B:
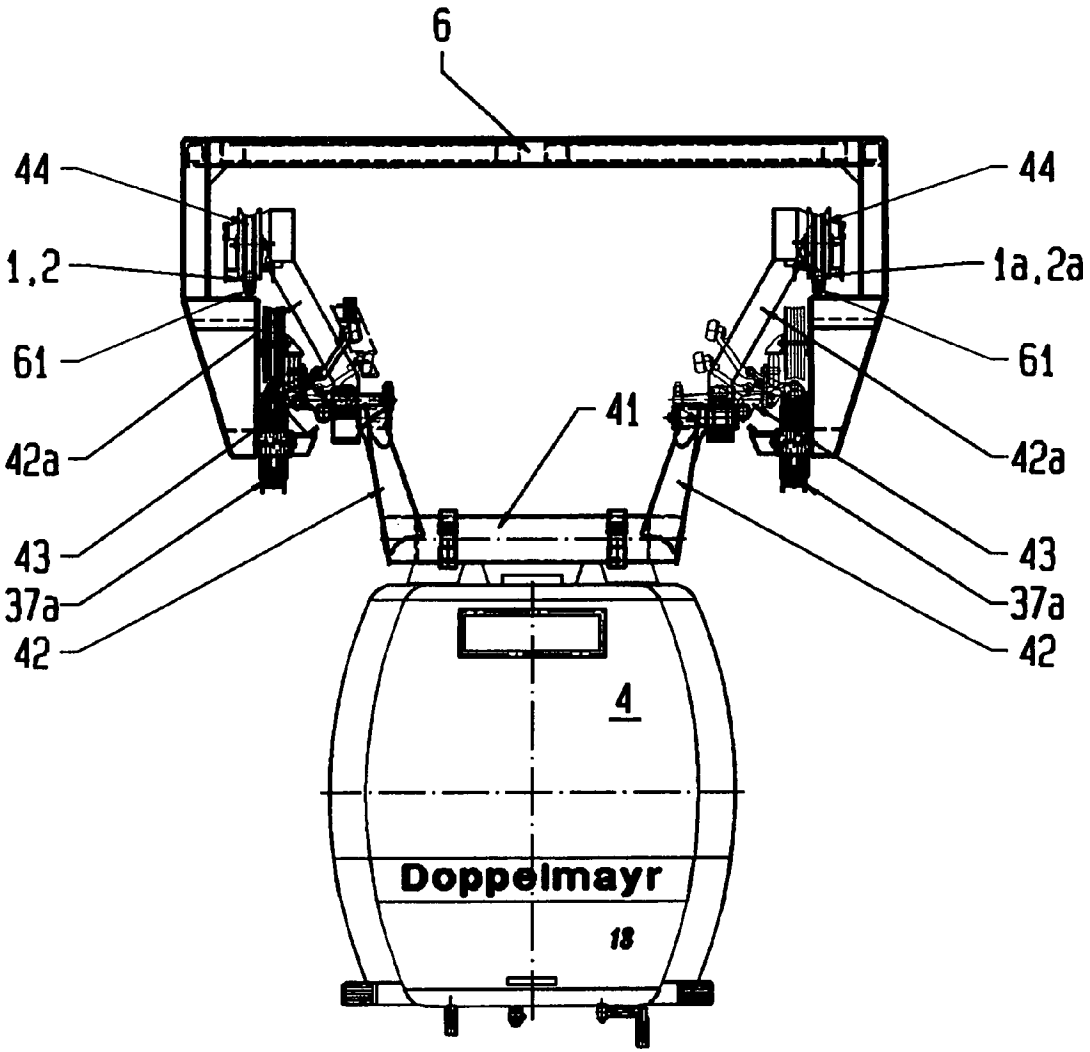
FIG. 5B is a front view of a variant embodiment of the cable car cabin of FIG. 5.

As is illustrated in FIG. 5B, the two respectively assigned supporting cables 1, 1*a* and 2, 2*a* can be connected to each other over the course of the route by means of bars 6. In this case, these bars 6 are fastened to the supporting cables 1, 1*a* and 2, 2*a* from below by means of clamps 61. In addition, further supporting rollers 37*a* for the traction cable 2 are mounted on each side of the bars 6.

Figure 6A:
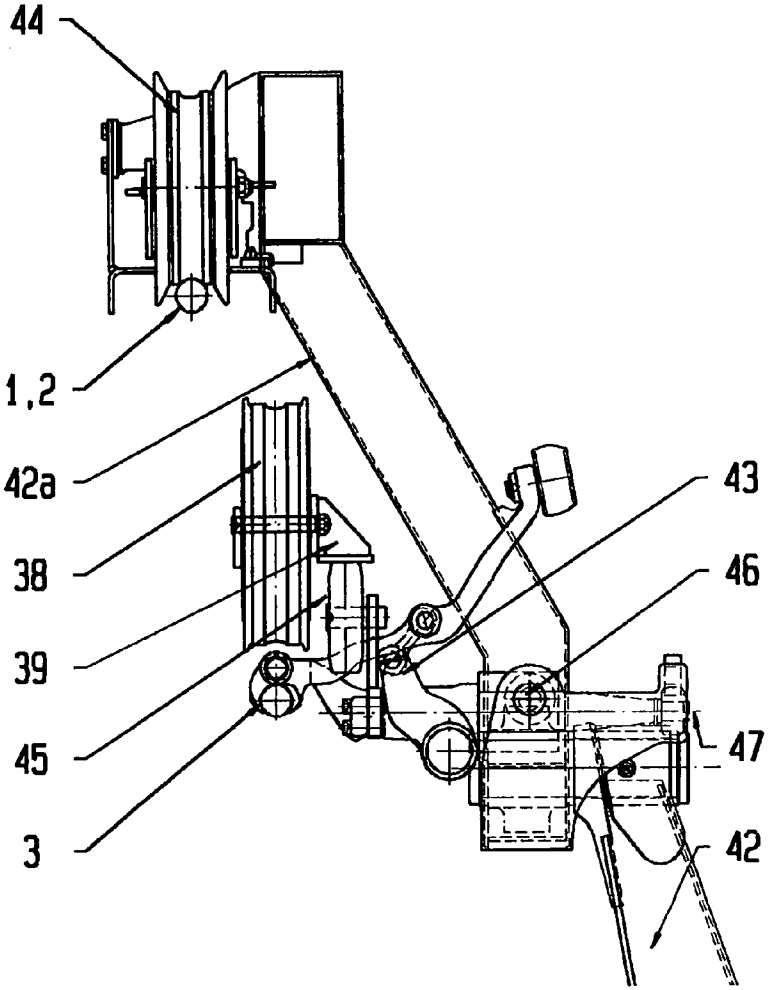
FIG. 6A is a similar view showing the clamped cabin in the region of holding-down rollers.
Figure 6:
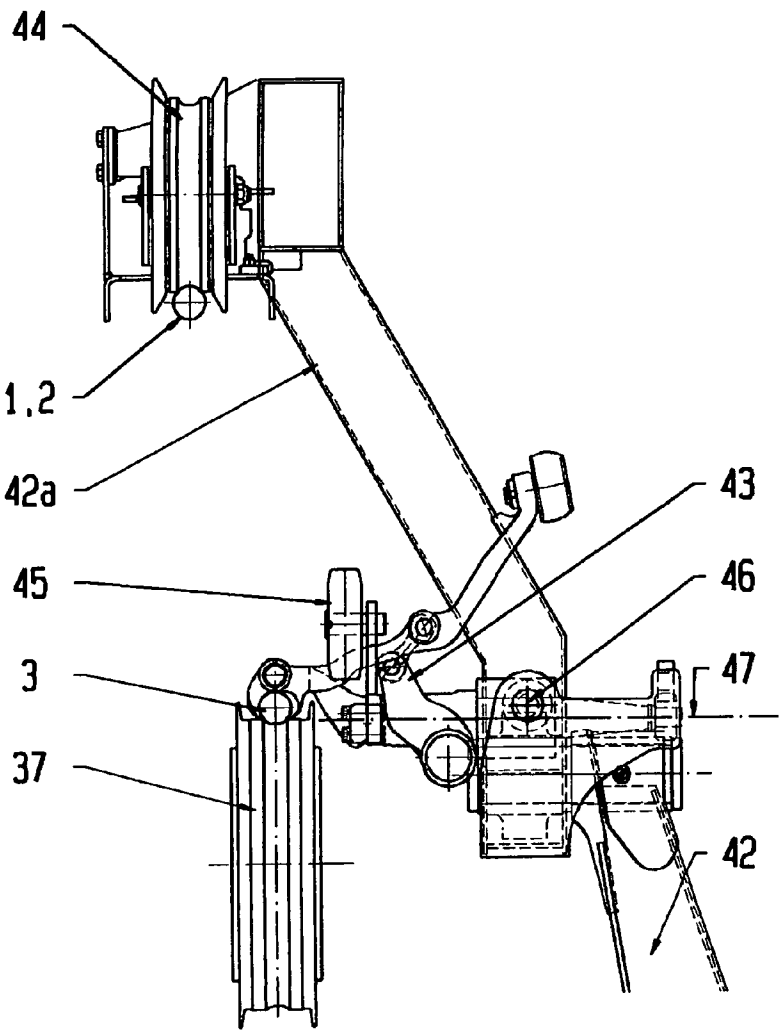
FIG. 6 is a detail view of the clamping mechanism with the cabin clamped onto the traction cable in the region of supporting rollers.

As is apparent from FIGS. 6 and 6A, the clamping jaws of the coupling apparatuses 43 come into action on the strands 3*a*, 3*b*, 3*c*, 3*d* of the traction cable 3 from above, as a result of which no impact shocks at all occur when the coupling apparatuses 43 move over the supporting rollers 37. In contrast, as is apparent from FIG. 6A, in the region of hold-down rollers 38, on which the strands 3*a*, 3*b*, 3*c*, 3*d* of the traction cable 3 are situated on the lower side of the holding-down rollers 38, the clamping jaws of the coupling apparatuses 43 would run onto the hold-down rollers 38, as a result of which the cabins 4 would be subjected to impact shocks.

In order to avoid impact shocks of this type, the coupling apparatuses 43 are provided with upwardly protruding supporting rollers 45 which are assigned supporting surfaces 39 on the hold-down rollers 38. In addition, the coupling apparatuses 43 can be pivoted about a respective bolt 46 running in the direction of the cable 3. As soon as a coupling apparatus 43 enters into the region of the hold-down rollers 38, the supporting rollers 45 run onto the supporting surfaces 39, as a result of which the clamping jaws of the coupling apparatus 43 are pivoted about the bolt 46 and are thereby lifted downward off the hold-down rollers 38. This prevents impact shocks, which are produced by the movement of the clamping jaws over the hold-down rollers 38, from affecting the cabins 4. In addition, the coupling apparatuses 43 are mounted in a manner such that they can pivot with respect to the supporting bars 42, 42*a* about a respective axis 47 which is aligned transversely with respect to the traction cable 3.

The instant application claims the foreign priority under 35 U.S.C. § 119 of Austrian patent application A 1118/2003 of Jul. 17, 2003, which is herewith incorporated by reference.

I claim:

1. A cable car system, comprising:

two pairs of supporting cables respectively anchored in a valley station and in a mountain station;

a single self-contained traction cable formed with two loops substantially extending between the valley station and the mountain station, said self-contained traction cable having two strands commonly moving in a direction towards the valley station and two strands commonly moving in a direction towards the mountain station;

a plurality of cabins each having a pair of laterally spaced-apart coupling devices for coupling said cabins to said two strands of said self-contained traction cable for movement along said supporting cables, and for decoupling said cabins from said traction cable for movement along guide rails respectively disposed in the valley station and in the mountain station.

2. The cable car system according to claim 1, wherein said supporting cables of the respective said pairs of supporting cables are disposed apart from one another by a spacing distance greater than a width of said cabins, and wherein said cabins are moved between said supporting cables of the respective said pair in each case.

3. The cable car system according to claim 2, wherein said commonly moving strands of said traction cable are disposed apart from one another by a spacing distance greater than the width of said cabins, and said cabins are disposed between said commonly moving strands of said traction cable.

4. The cable car system according to claim 3, wherein said commonly moving strands of said traction cable are disposed, transversely with respect to a direction of movement of said cabins, between said cabins and said supporting cables of the respective said pairs of supporting cables.

5. The cable car system according to claim 1, wherein said commonly moving strands of said traction cable are disposed apart from one another by a spacing distance greater than a width of said cabins, and said cabins are disposed between said commonly moving strands of said traction cable.

6. The cable car system according to claim 1, which comprises a plurality of mutually spaced-apart bars disposed above the respective said pairs of supporting cables and disposed to connect said supporting cables of said pairs of supporting cables to one another.

7. The cable car system according to claim 6, which comprises clamps for connecting said bars to said supporting cables from below.

8. The cable car system according to claim 6, which comprises supporting rollers for said traction cable mounted on said bars.

9. The cable car system according to claim 1, wherein said coupling devices are pivotally mounted to suspension bars of said cabins about an axis extending substantially parallel to a direction of movement of said traction cable for coupling to said strands of said traction cable.

10. The cable car system according to claim 9, wherein said coupling devices are pivotally disposed about axes transversely to the direction of movement of said traction cable and approximately horizontally, for coupling said coupling devices to said two commonly moving strands of said traction cable.

11. The cable car system according to claim 1, wherein said coupling devices are pivotally mounted to suspension bars of said cabins about axes extending approximately horizontally and transversely to a direction of movement of said traction cable, for coupling to said two commonly moving strands of said traction cable.

12. The cable car system according to claim 1, wherein:

said commonly moving strands of said traction cable are guided between said valley station and said mountain station at a substantially equal height level;

two deflecting pulleys are disposed in one of said valley and mountain stations for guiding a respectively outer strand of said traction cable, and a driving pulley formed with two cable grooves for all of said strands of said traction cable; and a reversing pulley is disposed in the other of said valley and mountain stations for guiding the respectively inner strands of said traction cable, and two mutually associated deflecting pulleys for guiding the outer strands of said traction cable.

13. The cable car system according to claim 1, wherein said coupling devices are mounted to suspension bars for said cabins and supporting rollers are disposed to project upwardly from said coupling device, wherein said supporting rollers are adapted to roll along supporting surfaces formed on supports for hold-down rollers whereby coupling clamps attaching said coupling devices to said supporting cable are lifted off from the holding-down rollers in a vicinity thereof.

* * * * *